United States Patent [19]

Müller et al.

[11] 4,278,960

[45] Jul. 14, 1981

[54] TEMPERATURE CONTROLLED BIMETAL SWITCH

[75] Inventors: Manfred K. Müller, Pforzheim, Fed. Rep. of Germany; Tomoyoshi Uchiya, Misato, Japan

[73] Assignees: Limitor AG, Zurich, Switzerland; Uchiya Thermostat Co., Saitama, Japan

[21] Appl. No.: 56,508

[22] Filed: Jul. 11, 1979 (Under 37 CFR 1.47)

[30] Foreign Application Priority Data

Jul. 15, 1978 [DE] Fed. Rep. of Germany ..... 2831198

[51] Int. Cl.[3] ..... H01H 37/54

[52] U.S. Cl. ..... 337/365; 337/372; 337/381

[58] Field of Search ..... 337/89, 343, 365, 372, 337/380, 381, 344–348, 366–368, 112, 113; 361/26

[56] References Cited

U.S. PATENT DOCUMENTS

| | | | |
|---|---|---|---|
| 3,263,049 | 7/1966 | Doherty | 337/343 |
| 3,541,488 | 11/1970 | Odson | 337/380 |
| 3,936,788 | 2/1976 | Uchiya | 337/343 |

FOREIGN PATENT DOCUMENTS 1301927 6/1964 France .

*Primary Examiner*—William H. Beha, Jr.
*Attorney, Agent, or Firm*—Toren, McGeady and Stanger

[57] ABSTRACT

A temperature-controlled bimetal switch is formed of a flat housing with an upper wall and a lower wall closely spaced apart. A fixed contact is secured to the inner surface of the upper wall and a curved bimetal snap plate and a contact spring are positioned between the upper and lower walls. The housing is formed of a transparent or translucent rigid plastics material permeable to radiant heat. A movable contact is formed on one end of the contact spring and is displaceable into and out of contact with the fixed contact by the snap plate. The snap plate is loosely secured to the contact spring and is positioned so that radiant heat passing through the housing directly impinges on the snap plate.

9 Claims, 3 Drawing Figures

TEMPERATURE CONTROLLED BIMETAL SWITCH

SUMMARY OF THE INVENTION

This invention relates to a temperature-controlled bimetal switch comprising a contact spring, which is fixed at one end, and a bimetal element, which is separate from and operatively connected to the contact spring.

For many applications, such switches are required to have a particularly fast response. To promote the heat transfer from the environment to the switch, it is known to provide for such switches a housing consisting of a metal which has a high thermal conductivity.

It is known from Opened German Specification No. 1,490,086 to provide an open switch, i.e., a switch which is not incorporated in a housing, and which has a bimetal element that is disposed on the outside of the switch and coated with black paint.

It is an object of the invention to provide a temperature-controlled bimetal switch which is of the kind described first hereinbefore and has a particularly fast response.

In a temperature-controlled bimetal switch enclosed in a housing, that object is accomplished by the combination of the following features: The housing is flat and consists of dimensionally stable, transparent or translucent plastic material; the bimetal element consists of a snap plate and is loosely secured to the outside of the contact spring between hooks, lugs or the like holding means.

All these measures promote a fast response. An important concept of the invention is based on the recognition that a low heat capacity of the switch is more important for a fast response than a high thermal conductivity of the housing and the components contained therein. For this reason, the housing is as small as possible and is particularly flat and made of plastic material which has inherently a low heat capacity. The arrangement of the bimetal element on the contact spring, on which it is held loosely only between hooks or the like, affords the advantage that the bimetal element is thermally insulated to a high degree from the contact spring, which has a much higher heat capacity, so that the temperatures of the contact spring has only a small influence on the response behavior of the switch.

Whereas it is known from U.S. Pat. No. 3,936,788 to provide the bimetal element on a contact spring, on which the bimetal element is only loosely held between lugs, that contact spring is not fixed at one end but is loosely arranged in the housing and can be actuated only by a bimetal plate which is held on the contact spring so that the arrangement of the bimetal plate is required by the use of a loose contact spring.

Another advantage of the loose bimetal plate resides in that it facilitates the provision of a flat switch. In a switch having a bimetallic contact spring, the low spring rate of bimetals requires that the bimetal spring must be much thicker and must perform a much larger excursion in order to provide the force required to close the contacts than in a switch which has a loose bimetal plate because in the latter switch the contact spring may be made of a material having good spring properties and for this reason may be very thin. Additional space for the loose bimetal plate is not required because that plate may be accommodated in the space which is anyway required for the contact-opening movement of the contact spring. If curved bimetal plates are used, which abruptly change their curvature when a predetermined response temperature is exceeded (such bimetal plates are usually called "snap plates"), adequate closing and opening forces can be provided even when the excursion of the contact spring is only small. Another disadvantage of a switch having a bimetallic contact spring resides in that the heat capacity is much higher than that of a loose bimetal element.

Owing to the flat design and the small switching movement, the dimensional stability is of high importance. For this reason the plastic material used for the housing must be dimensionally stable.

Another concept of the invention is to ensure an optimum access of radiant heat to the bimetal element. For this reason the switch is not only flat but the housing is transparent or translucent and the bimetal element is secured to the contact spring on the outside of the latter and preferably so that the active surface of the bimetal element faces outwardly.

The active side of the bimetal element is that side which has the higher coefficient of expansion. The arrangement of the bimetal element so that its active side faces outwardly is based on the recognition that the response speed of a temperature controlled bimetal switch depends decisively on the unobstructed access of the heat to the active side of the bimetal element to heat that active side. On the other hand, a heating of the inactive side of the bimetal element is not desirable for a fast response. Whereas in bimetallic overcurrent switches, the bimetal element is flown through the current, no heat is generated in a temperature controlled bimetal switch but heat is supplied to such switch from the outside so that it will promote a fast response if the active side of the bimetal element faces outwardly because the active side is then heated first and is not shielded from the outside by the inactive side.

If, as will be claimed, the active side of the bimetal element faces outwardly, the movement performed by the contact spring in response to a temperature rise above the response temperature will be opposite to the direction of such movement in the known switches. For this reason the arrangement of the contacts must be altered.

The inactive side of bimetal element consists usually of an iron-nickel alloy having a high nickel content (about 36–48% nickel). These materials are bright and reflect radiant heat. The alloys used for the active side often contain manganese; such materials are dark and dull and can absorb radiant heat much more effectively than the bright materials used on the inactive side of the bimetal elements. This is another advantage afforded by the invention.

In temperature-controlled bimetal switches enclosed in a plastic material housing it has been found that the disadvantage that plastic materials inherently have a low thermal conductivity can be more than offset by the fact that they have a lower heat capacity than metals. This is of special significance also regarding the length of the time for which a switch remains open when the ambient temperature has dropped below the response temperature. A metal housing will hold the heat much longerthan a comparable plastic housing and for this reason responds much more slowly to a temperature change. Polyamide 6,6, polyamide 12, and polyethylene terephthalate have proved to be particularly satisfactory plastic materials for the switch housings.

Switches having bimetal elements which are separate from the contact springs tend to respond much faster than switches having a bimetallic contact spring. This is to the facts that contact springs have by necessity a higher heat capacity and that heat is lost by conduction from the contact springs at the contacts and the mountings. A particularly favorable behavior will be exhibited by a switch in which the bimetal element is loosely held between hooks, lugs or the like holding means on the outside of the contact spring. In that case, the temperature response of the bimetal element is not changed as it is installed. Besides, the contact surface area between the bimetal element and the contact spring is only small and in an ideal case there is only a line contact. As a result, the loss of heat by conduction from the bimetal element to the contact spring is small. In adaptation to the configuration of the contact spring the bimetal elements which are employed may have the configuration of a rectangle, which may have rounded corners, or of a square, circle or oval. They are embossed to have a predetermined curvature so that they will suddenly change their direction of curvature in response of a temperature rise beyond the set-point temperature rise beyond the set-point temperature.

A very flat design will be possible if the housing is also an electrically insulating carrier for the electrically conducting parts. A particularly desirable switch comprises a flat housing which consists of plastic material and in which the contact spring is secured to one main wall of the housing and carries a contact facing the other main wall, to which the fixed contact is secured, whereas the leads connected to the contacts extend out of the housing at opposite ends thereof so that the lead connected to the fixed contact will not shield the bimetal element. When it is desired for both leads to extend out of the housing at the same end thereof, this can be accomplished, without a shielding of the bimetal element, in that the lead connected to the fixed contact extends on one of the side walls which are adjacent to the fixed contact, or on the end wall that is opposite to the outlet of the housing, to that main wall of the housing to which the contact spring is secured.

In a temperature-controlled flat, open bimetal switch, the above-mentioned object may be accomplished in that the bimetal element consists of a snap plate and is loosely secured to the outside of the contact spring between hooks, lugs or the like holding means.

In a preferred open switch, in which the contact spring and a fixed contact are secured to one side of an electrically insulating carrier whereas the bimetal element is held by the carrier on the opposite side and acts by a connecting member on the contact spring, that object may be accomplished in that the bimetal element consists of a bimetalic snap plate, which may have the shape of a disc or strip and is held at its edge or at mutually opposite edge portions by lugs or the like, and in that the connecting member consists of a pin, which is secured to the bimetal element and/or to the contact spring and protrudes through an opening in the carrier and is made of a material having a poor thermal conductivity.

In such switch the bimetal element is separated from the contact spring by the carrier, which is electrically non-conducting and has a low thermal conductivity so that heat generated by the flow of current in the contact spring exerts virtually no influence on the response of the switch.

As the contact pressure, i.e., the pressure with which the contact carried by the contact spring is urged against the fixed contact, is exerted by the bimetal element, the latter need not overcome the spring force of the contact spring in opening the switch. Another advantage of such switch resides in that in opening the switch the contact spring moves inwardly, toward the carrier; this feature permits a fairly compact design. The pin may be secured only to the contact spring or only to the bimetal element although the switching will be more reliable if the pin is secured to both components.

To prevent a heat transfer from the contact spring to the bimetal element the pin suitably consists of a material of low thermal conductivity and contacts the bimetal element and contact spring only in small areas.

Advantageous embodiments of the invention are diagrammatically shown on the accompanying drawings and will be described hereinafter. In the drawings,

BRIEF DESCRIPTION OF THE INVENTION

Figure 1:
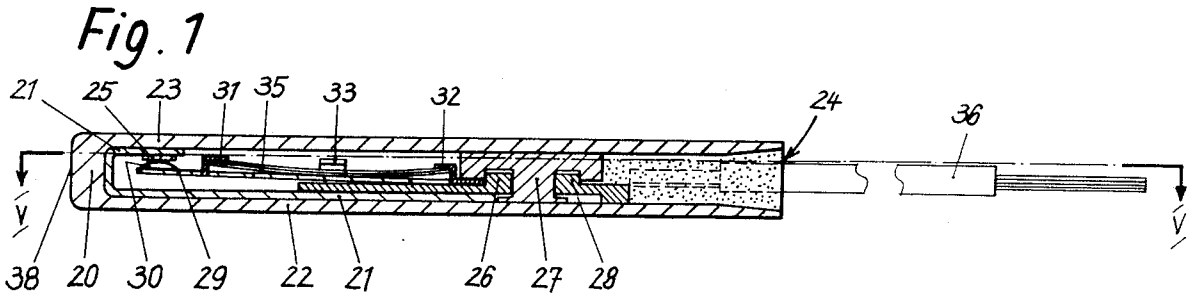
FIG. 1 is a longitudinal sectional view showing an enclosed switch.
Figure 2:
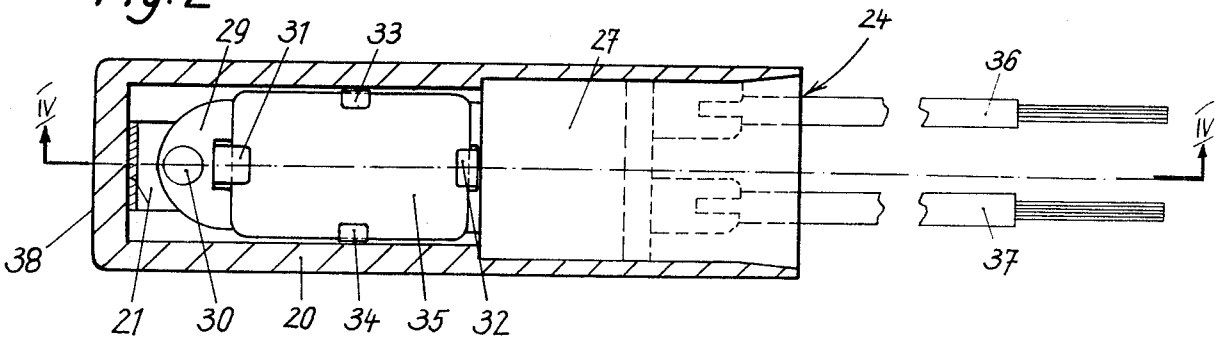
FIG. 2 is a sectional view taken on line V—V in FIG. 1.

The enclosed switch shown in FIGS. 1 and 2 has a flat housing 20 of polyamide reinforced with glass fibers. In the housing 20, an electrically conducting strip 21 extends along the lower main wall 22 of the housing into the latter and at the end of the housing is bent upwardly and extends on the upper main wall 23 toward the outlet 24 of the housing. A downwardly facing, fixed contact 25 is welded to that conductor strip 21 at the end thereof. A contact spring 29 extends into the housing 20 and is separated from the conductor strip 21 by a plurality of insulators 26 to 28. The contact spring 29 is fixed at one end between the insulators 26 and 27 and at the other end carries a movable contact 30 for cooperation with contact 25. A bimetal plate 35 is loosely held on the top of the contact spring 29 by four lugs 31 to 34. The active side of the bimetal plate 35 faces upwardly, away from the contact spring 29. The bimetal plate 35 is curved so that the short edges at which the plate is held by the lugs 31 and 32 are upwardly inclined at temperatures below the response temperature of the plate 35. When the temperature rises beyond the response temperature of the bimetal plate 35, the latter abruptly changes its sense of curvature so that its short edges are now downwardly inclined and urge its long edges against the underside of the lugs 33 and 34. The contact spring 29 underside of the lugs 33 and 34. The contact spring 29 is thus downwardly deflected to open the switch. The lugs 31 to 34 have been struck out from the contact spring 29 by a stamping operation.

The two electric leads 36, 37 are led out through the common outlet 24 of the housing. When the switch has been inserted into the housing 20, the outlet 24 is tightly cast up with epoxy resin.

Rather than extending out of the housing at the same end, the leads may extend out of the housing at opposite ends if the conductor strip 21 is replaced by a conducting strip that extends out of the housing parallel to the upper main wall 23 of the housing through the end wall 38 which is opposite to the outlet 24.

Figure 3:
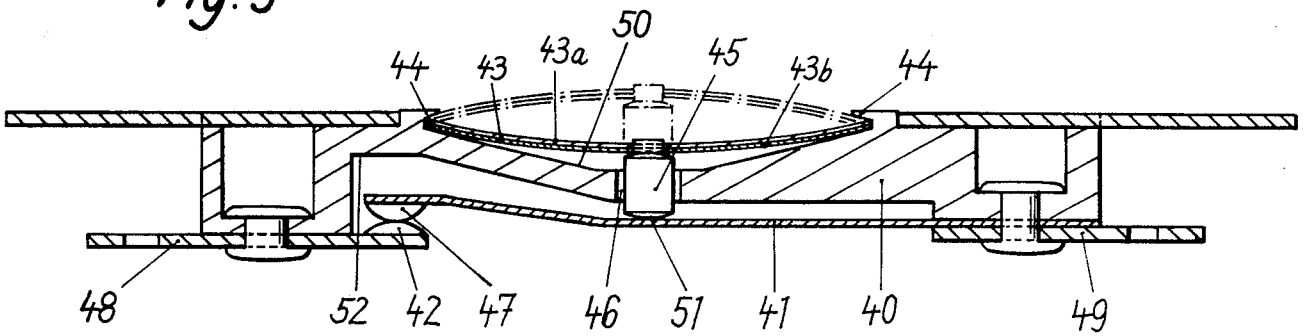
FIG. 3 is a longitudinal sectional view showing a switch in which the contact spring and the bimetal element are disposed on opposite sides of a carrier.

The open switch shown in FIG. 3 has a very fast response and the behavior of its bimetal element 43 is virtually not influenced by the heat which is generated by the flow of electric current in the contact spring 41. This is due to the fact that the contact spring 41 and the bimetal element 43 are disposed on opposite sides of an electrically non-conducting carrying plate 40. The contact 47 secured to the movable end of the contact spring 41 faces away from the carrying plate 40 and cooperates with a fixed contact 42, which faces the carrying plate 40. The contact spring 41 and the fixed contact 42 are provided with respective soldering tags 48 and 49 for the connection to leads.

The bimetal element 43 is a strip, which is held at opposite ends by two lugs 44 of the carrying plate 40. The active side 43*a* of the element faces outwardly and its inactive side 43*b* faces inwardly. In a cold state, the bimetal element 43 is curved toward the carrying plate 40, which for this reason has a depression 50. By means of a pin 45 which is secured to the central portion of the bimetal element 43 and consists of a material having a low thermal conductivity, the bimetal element 43 urges the contact spring 41 against the fixed contact 42 when the bimetal element 43 is cold. The pin 45 extends through an opening 46 in the carrying plate 40 and has a crowned end face 51 that engages the contact spring 41.

When the curved bimetal element 43 is heated above its response temperature, it will suddenly change its direction of curvature (this is indicated in dotted lines in FIG. 3) so that the pin 45 disengages the contact spring 41. The contact spring 41 is prestressed in such a sense that it will then disengage the movable contact 47 from the fixed contact 42. In that operation, the free end of the contact spring 41 moves into a recess 52 formed in the carrying plate 40. When the temperature of the bimetal element 43 drops below its response temperature, the bimetal element 43 will snap back to its initial position to close the switch.

This switch may be used without a housing, as shown, but may alternatively be enclosed in a housing.

What is claimed is:

1. A temperature-controlled bimetal switch comprising an electrically insulated housing, a contact spring located within said housing, a curved bimetal snap plate in displacing contact with said contact spring, said housing being a flat structure having an upper wall and a lower wall closely spaced apart, said housing being formed of one of a transparent or translucent rigid plastics material permeable to radiant heat, said contact spring located between said upper and lower walls and being elongated and having a first end and a second end, said contact spring being secured within said housing at the first end thereof between said upper and lower walls, a fixed contact secured to said housing, said contact spring having a movable contact secured thereon adjacent the second end thereof for movement into and out of contact with said fixed contact, said bimetal snap plate being located between said spring and said upper wall so that radiant heat from the exterior of said housing passes through said upper wall and impinges directly on said bimetal snap plate, and holding means for loosely securing said snap plate to said contact spring so that said snap plate is held loosely on said contact spring while a major portion of the coextensive areas of said plate and spring are maintained out of contact.

2. A temperature-controlled bimetal switch as set forth in claim 1, in which said holding means are secured to said contact spring and extends therefrom toward said upper wall for loosely engaging said snap plate.

3. A temperature-controlled bimetal switch as set forth in claim 2, in which said fixed contact is secured to said upper wall, the first end of said contact spring being secured to said upper wall and on the side facing said lower wall, said bimetal snap plate being arranged to control the engagement of said movable contact with said fixed contract by such change of the sense of its curvature, and first and second leads are connected to said fixed and movable contacts, respectively, and extend out of the housing.

4. A temperature-controlled bimetal switch as set forth in claim 3, in which said first lead extends from said lower wall to said upper wall and said first and second leads extend out of the housing at the same end thereof.

5. A temperature-controlled bimetal switch as set forth in claim 4, in which said housing has two side wall disposed adjacent to said fixed contact and said first lead extends from said lower wall on one of said side walls to said upper wall.

6. A temperature-controlled bimetal switch as set forth in claim 1, in which said holding means comprise hooks engaging said bimetal snap plate.

7. A temperature-controlled bimetal switch as set forth in claim 1, in which said holding means comprise lugs formed from said contact spring and engaging said bimetal snap plate.

8. A temperature-controlled bimetal switch as set forth in claim 1, in which said bimetal snap plate has an active side facing away from said fixed contact and toward said upper wall.

9. A temperture-controlled bimetal switch as set forth in claim 1, in which said holding means are provided on the side of said contact spring that is opposite to said fixed contact.

* * * * *